US006663417B1

(12) United States Patent
Hung

(10) Patent No.: US 6,663,417 B1
(45) Date of Patent: Dec. 16, 2003

(54) ELECTRICAL CONNECTOR WITH LIGHT EMITTING DEVICE

(75) Inventor: Cheng-Lung Hung, Chilung (TW)

(73) Assignee: Weison Technologies Co., Ltd. (TW)

( * ) Notice: Subject to any disclaimer, the term of this patent is extended or adjusted under 35 U.S.C. 154(b) by 0 days.

(21) Appl. No.: 10/247,485

(22) Filed: Sep. 20, 2002

(51) Int. Cl.[7] ..... H01R 3/00
(52) U.S. Cl. ..... 439/490
(58) Field of Search ..... 439/490, 488, 439/489, 676, 607–610

(56) References Cited

U.S. PATENT DOCUMENTS 5,797,767 A * 8/1998 Schell ..... 439/490
5,975,943 A * 11/1999 Chou et al. ..... 439/490
6,142,822 A * 11/2000 Wu ..... 439/490
6,431,906 B1 * 8/2002 Belopolsky ..... 439/490

* cited by examiner

*Primary Examiner*—Lynn Feild
*Assistant Examiner*—Son V. Nguyen
(74) *Attorney, Agent, or Firm*—Bacon & Thomas, PLLC

(57) ABSTRACT

An electrical connector with light emitting device. The electrical connector includes a casing, an insulative housing disposed inside the casing. A light emitting device and a light transmitting element are disposed on top of the insulative housing. The insulative housing includes two slots disposed on top of the insulative housing. A groove is disposed on a distal front end of each of the slots. The light emitting device is fitted into the slot above the insulative housing so that a certain distance is maintained between the light emitting device in the slot and the light transmitting element. The casing covers the outer part of the insulative housing, the light transmitting device, and the light transmitting element wherein at least a front side of the insulative housing and a front side of the transmitting element are exposed.

4 Claims, 5 Drawing Sheets

ELECTRICAL CONNECTOR WITH LIGHT EMITTING DEVICE

BACKGROUND OF THE INVENTION

1. Filed of the Invention

The present invention relates to an electrical connector, and more particularly to the use and positioning of a light transmitting element and a light emitting device which allows the length of the conducting stands to be shorter, and the use of light gathering emitter emitting a clear and obvious light for indicating transmission status of the electrical connector by viewing the on/off status of light emitting device on the frontal visible side of the electrical connector.

2. Description of the Related Art

Following the rapid development of information technology and computer technology, advanced computer and notebook computer are continuously developed for providing advanced features, such as faster operating speed, multifunctional, slim, small and compactness. A variety of electrical connectors for use in computers and telephone line for connecting with an internet and/or an intranet server database to retrieve and/or transmit data. However, because of the use of external forces such as pulling force for unplugging the electrical connector from the socket or inserting force for plugging in the electrical connector into the socket physical cause damage, or while the data transmission process is taking place, if the electrical connector is unplugged, damage to the data transmission means within the expensive electrical device occurs. Therefore it is highly desirable to have a signal transmission indicator on the electrical connector to visually display the status of the electrical connector that is linked with expensive electronic devices in order to avoid disconnection of a electrical connector while transmission of data is taking place between an external source and the electronic device via electrical connector. Conventional electrical connector does not have any signal transmission indicator for displaying the signal transmission status. For achieving the foregoing objectives, some developed electrical connectors with light emitting diode. One such type of electrical connector available, as shown in FIGS. 4 and 5 comprises a light emitting diode mounted inside of the electrical connector with the lead wires soldered to the circuit board at the bottom side inside the electrical connector and a light guide strip is provided in the electrical connector for guiding the light of the light emitting diode directly to the front visible side of the electrical connector. Another conventional type of the electrical connector comprises a light emitting diode disposed inside the housing of the electrical connector and uses a light guiding plate made of light transmission material on the visible side of the electrical connector. Still another conventional type of the electrical connector comprises a light emitting diode directly soldered to the printing circuit at the bottom side inside the electrical connector, and the light guides are provided inside the electrical connector to guide light of the light emitting diode to the visible side (as shown in FIGS. 6 and 7). However, there are several drawbacks from using the electrical connectors mentioned above as described as follows:

1. Extended stand length is required for connecting the light emitting diode directly on the visible side of the electrical connector. Consequently, extension of stand length would easily cause the stand to undesirably deform and bent, and further it is both difficult to manufacture LED with extended stand length and also it is difficult to assemble LED with extended stand length.

2. Every kind of light emitting diode of electrical connector is astigmatic and unable to gather the projected light, the projected light gets dispersed and the light intensity of the light emitting diode reaching the front visible side of the electrical connector is relatively weakened, consequently the light intensity is not sufficient to provide desirable indication.
3. It takes one or more than one reflection to enter into the light guide strips that is located inside the electrical connector, consequently the intensity of the light is relatively weakened as the result of light. Thus, the light intensity is not sufficient to provide desirable indication.

According to the above-mentioned defects to create an improved signal transmission indicator in an electrical connector is highly desirable.

SUMMARY OF THE INVENTION

Accordingly, in the view of the foregoing, the present inventor makes a detailed study of related art to evaluate and consider, and uses years of accumulated experience in this field, and through several experiments, to create a new and improved electrical connector with a light emitting device of the present invention. The present invention provides an innovated cost effective electrical connector which can overcome the problems encountered in the conventional electrical connectors as described above.

Accordingly it is another object of the present invention to provide an electrical connector with a light emitting device arrangement wherein the signal transmission status of the electrical connector can be easily visualized by viewing the on/off status of light transmitting device on the frontal visible side of the electrical connector.

It is another object of the present invention to provide an improved electrical connector with a light emitting device arrangement wherein the loss of light intensity due to reflection is avoided. Thus the intensity of light is not relatively weakened providing a clear and obvious light indication on the front visible side of the electrical connector.

In order achieve the above objects and other objects of the present invention, an electrical connector with light emitting device of the present invention is provided. The electrical connector comprises a casing, an insulative housing disposed inside the housing and a light emitting device disposed on top of insulative housing. The housing covers the outer part of the insulative housing, wherein at least a front side of the insulative housing is exposed. The insulative housing comprises two slots disposed on top of the insulative housing. A groove is disposed on a front end of each of the slots. The groove is for fixing a light transmitting element, and the other end of the slot is form an opening.

According to an aspect of the present invention, the light emitting device is a light gathering emitter.

According to another aspect of the present invention, the light emitting device comprises a plurality of conducting stands extending from a distal end. The conducting stands of the light emitting device is bent into a L shape.

According to another aspect of the present invention, the light emitting device is fitted into the slot above the insulative housing in a such a manner that a certain distance is maintained between the light emitting device in the slot and the light transmitting element. The use and positioning of the light transmitting element in the slots eliminates the need of installing directly onto the front visible side of the electrical connector, therefore this arrangement allows the length of the conducting stands to be shorter for extending under the insulative housing, thus the problems from long conducting stands of the light emitting device can be effectively mitigated.

According to another aspect of the present invention, during the actual operation of the electrical, the light emitting device projects gathered light to the light transmitting element which is located at a frontal side of the slot to make the light glow on the front visible side of the electrical connector through the light transmitting element.

According to another aspect of the present invention, the signal transmission status of the electrical connector can be easily visualized by viewing the on/off status of light emitting device on the frontal visible side of the electrical connector.

According to another aspect of the present invention, the light emitting device of the adaptor generates gathered light and projects to the light transmitting device to make the light transmitting element to glow clearly without light astigmatism or reflection by other object thus the intensity of light is not relatively weakened providing a clear and obvious light indication on the front visible side of the electrical connector.

DESCRIPTION OF THE PREFERRED EMBODIMENTS

Figure 1:
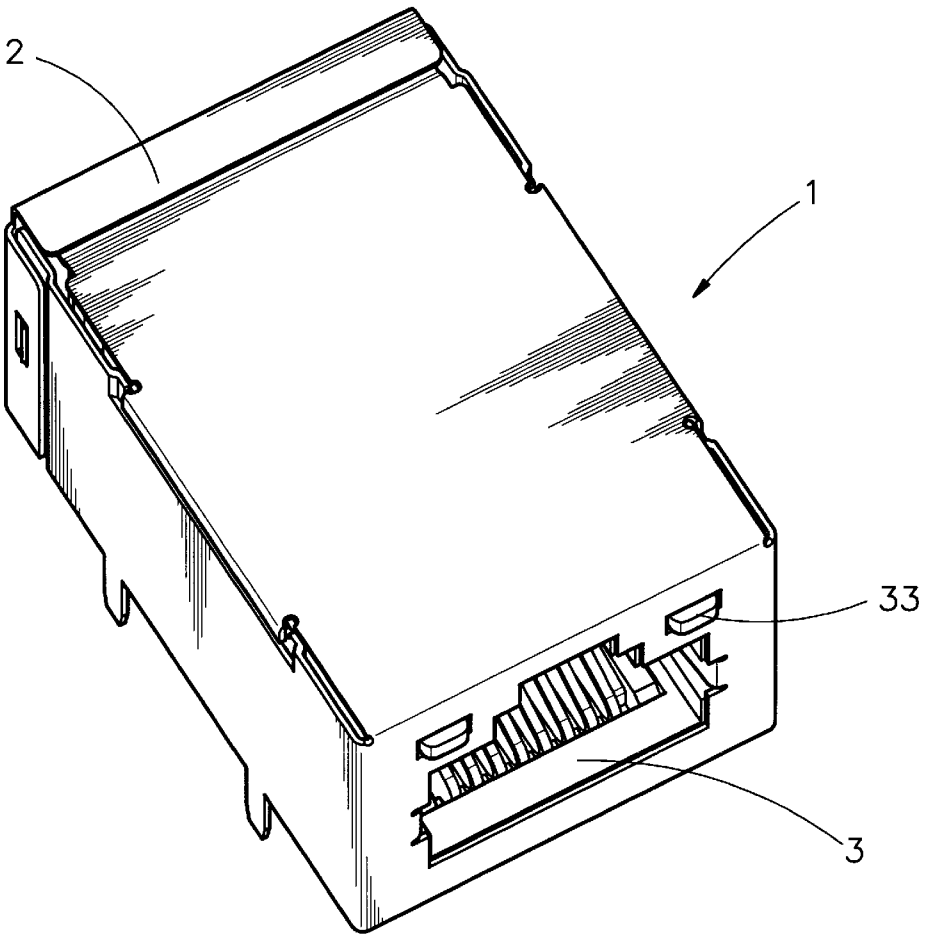
FIG. 1 is an elevational view of an electrical connector with a light emitting device constructed according to the present invention.

Reference will be made in detail to the preferred embodiments of the invention, examples of which are illustrated in the accompanying drawings. Wherever possible, the same reference numbers are used in the drawings and the description to refer to the same or like parts.

Figure 2:
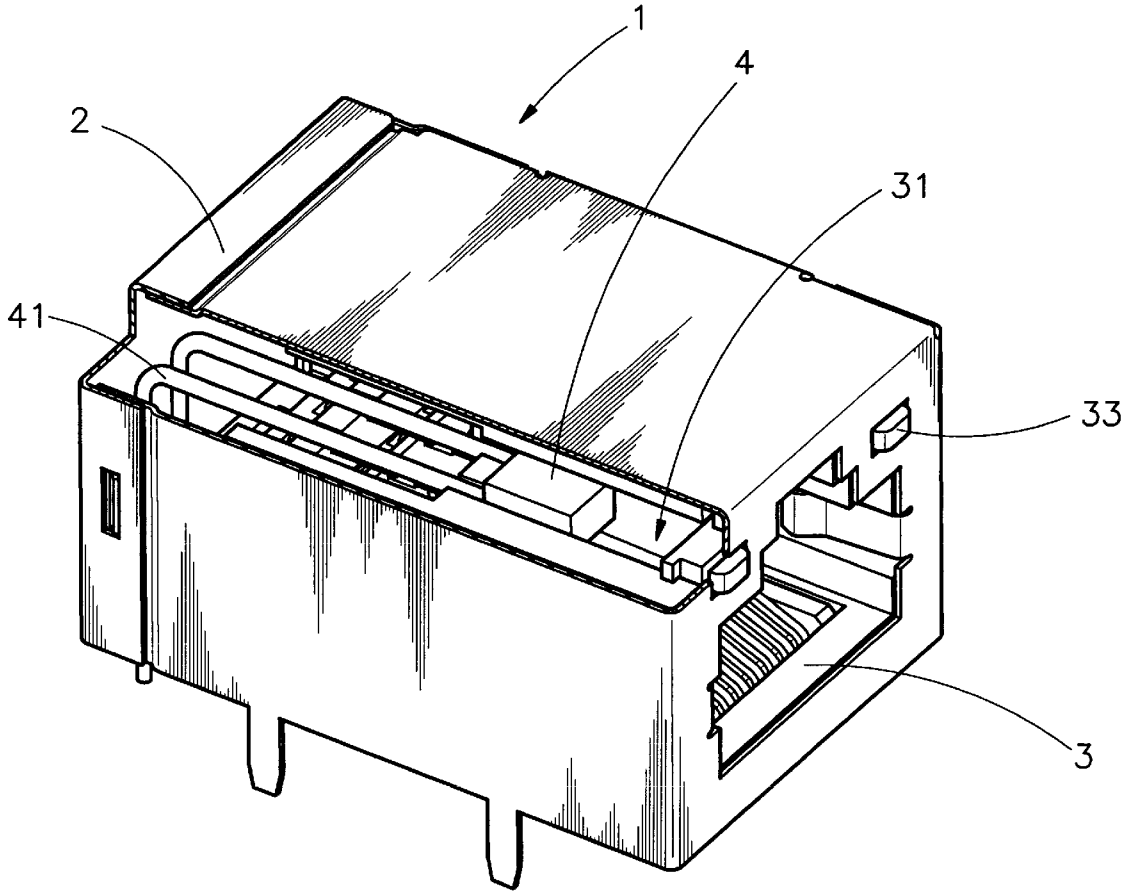
FIG. 2 is a sectional view showing the light emitting device inside the electrical connector according to the present invention.
Figure 3:
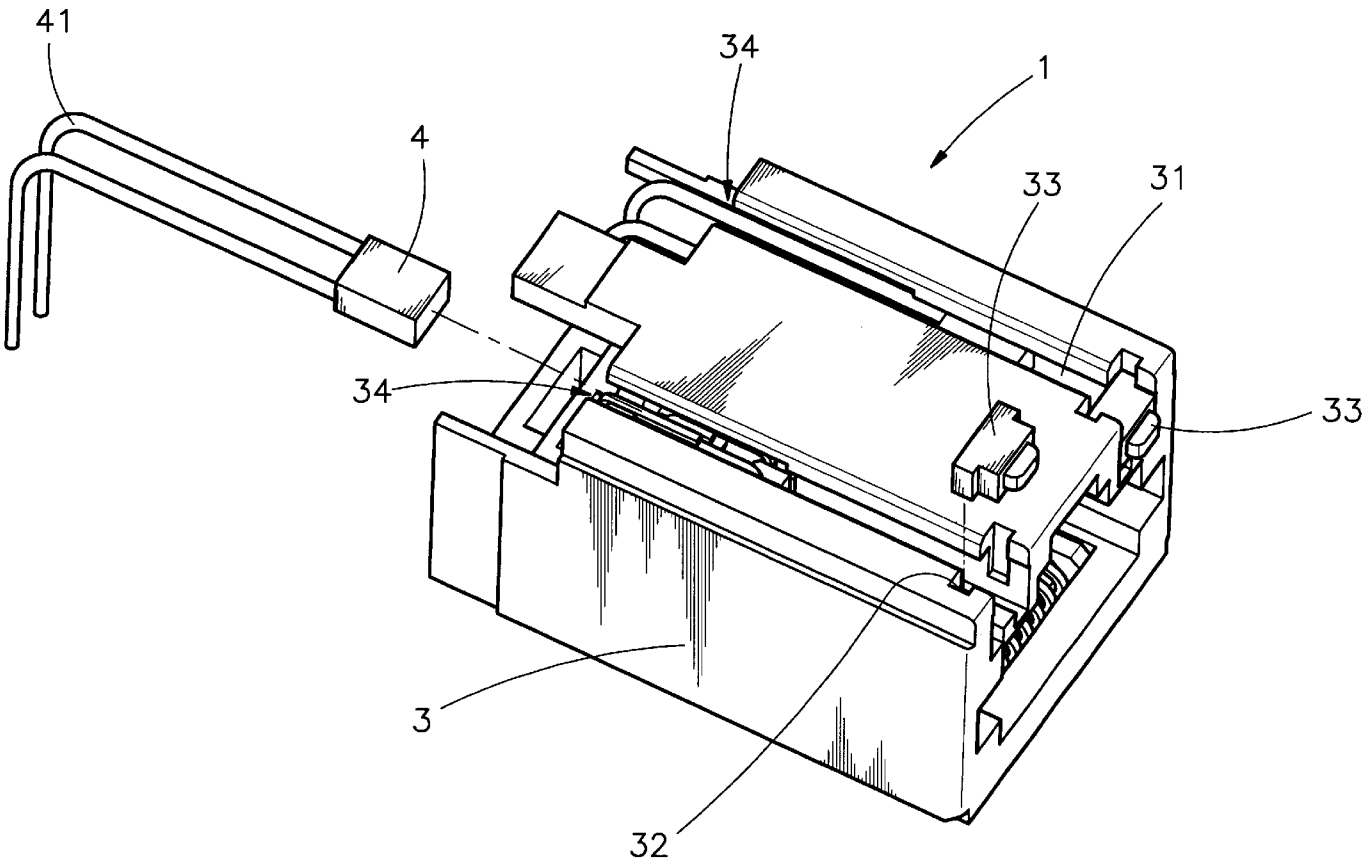
FIG. 3 is an exploded view of the electrical connector constructed according to the present invention.
Figure 4:
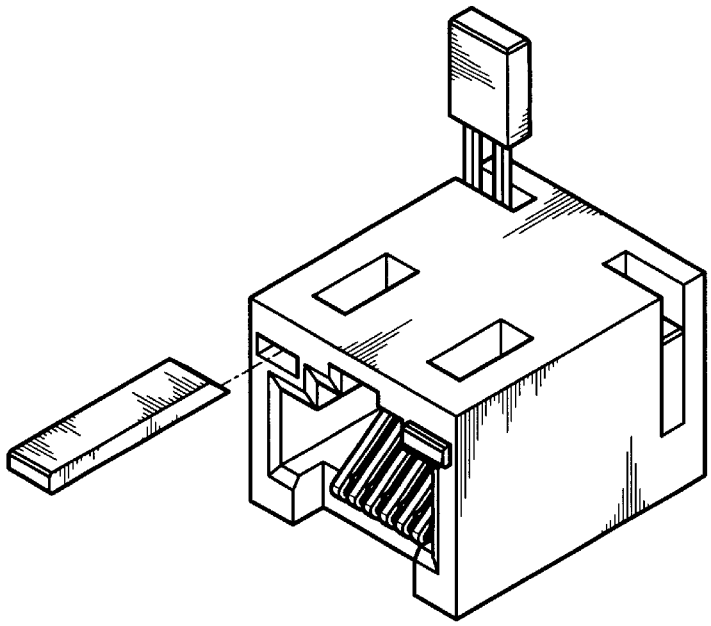
PRIOR ART FIG. 4
FIG. 4 is an exploded view of a conventional electrical connector.
Figure 5:
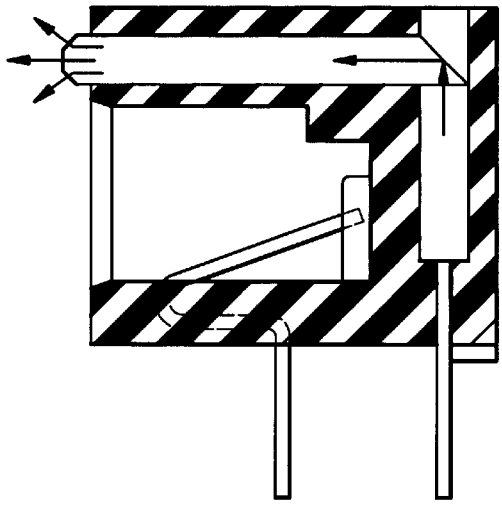
PRIOR ART FIG. 5
FIG. 5 is a sectional view of the conventional electrical connector shown in FIG. 4.
Figure 6:
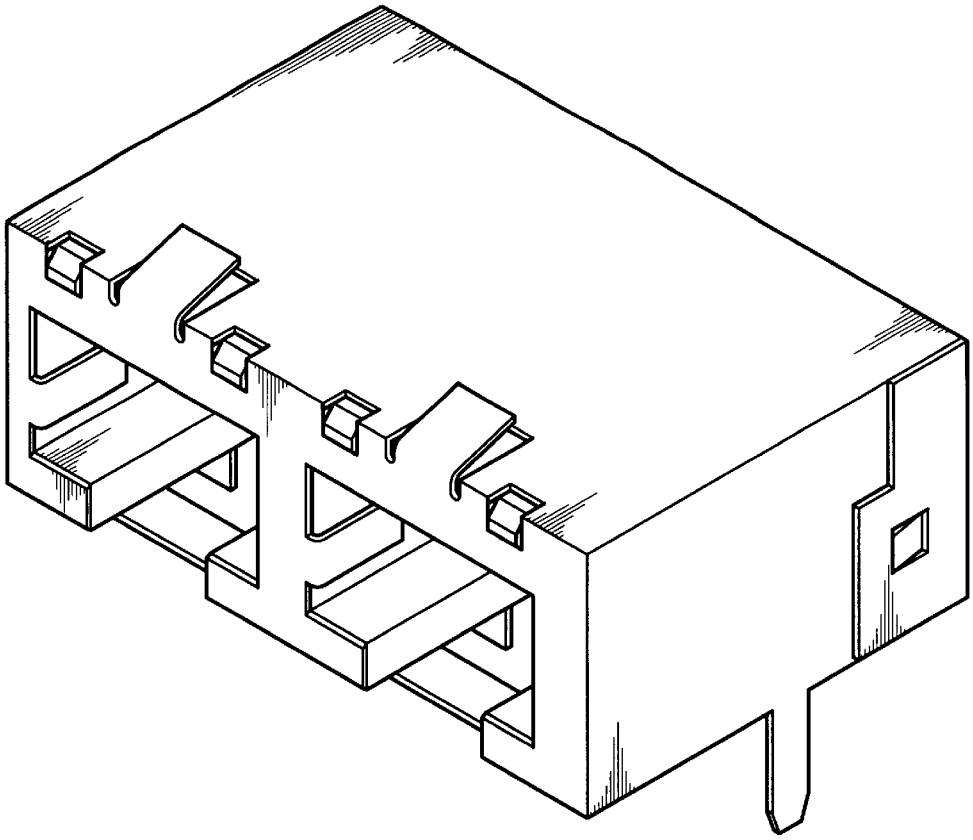
PRIOR ART FIG. 6
FIG. 6 is an elevational view of another conventional electrical connector.
Figure 7:
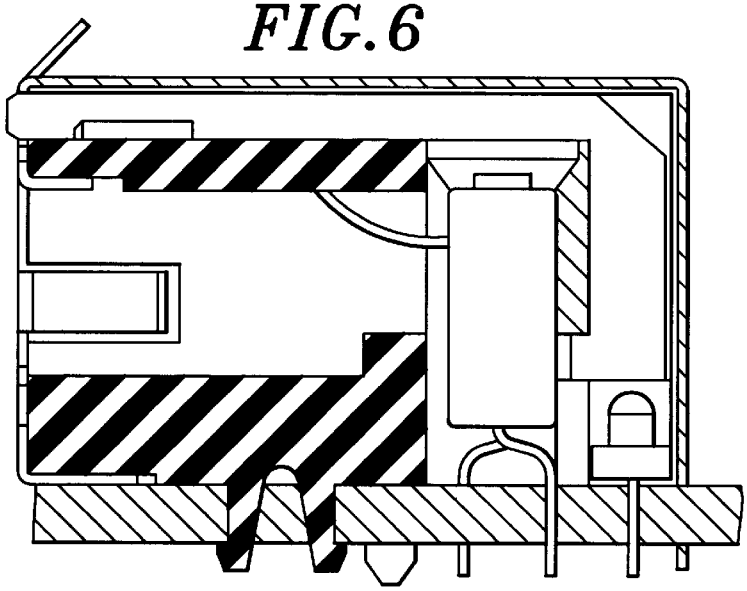
PRIOR ART FIG. 7
FIG. 7 is a sectional view of the conventional electrical connector shown in FIG. 6.

Referring to FIGS. 1, 2 and 3, an electrical connector with light emitting device of the present invention is shown. The electrical connector 1 comprises a casing 2, an insulative housing 3 disposed inside the housing 2 and a light emitting device 4 disposed on top of insulative housing 3. The housing 2 covers the outer part of the insulative housing 3, wherein at least a front visible side of the insulative housing 3 is exposed. The insulative housing 3 comprises two slots 31 disposed on top of the insulative housing 3. A groove 32 is disposed on a front end of each of the slots 31. The groove 32 is for fixing a light transmitting element 33, and the other end of the slot 31 is form an opening 34.

The light emitting device 4 is a light gathering emitter. The light emitting device 4 comprises a plurality of conducting stands 41 extending from a distal end. The conducting stands 41 of the light emitting device 4 are bent into a L shape.

The above mentioned light emitting device 4 is fitted into the slot 31 through the opening 34 above the insulative housing 3 in a such a manner that a certain distance is maintained between the light emitting device 4 in the slot 31 and the light transmitting element 33. The light emitting device 4 is fitted inside the slot 31 with the conducting stands 41 extending below the insulative housing 3, and the casing 2 covers and surrounds the insulative housing 3, the light emitting device 4, the light transmitting element 33 with the light emitting device 4 positioned over the insulative housing 3, wherein at least a front side of the light transmitting element 33 and a front side of the insulative housing 3 are exposed, to constitute the electrical connector 1 of the present invention. The use and positioning of the light transmitting device 4 in the slots 31 eliminates the need of installing directly onto the front visible side of the electrical connector 1, therefore this arrangement allows the length of the conducting stands 41 to be shorter for extending under the insulative housing 3, thus the problems from long conducting stands 41 of the light emitting device 4 can be effectively mitigated. During the actual operation of the electrical 1, the light emitting device 4 projects gathered light to the light transmitting element 33 which is located at a frontal side of slot 31 to make the light glow on the front visible side of the electrical connector 1 through the light transmitting element 33. Thus the signal transmission status of the electrical connector 1 can be easily visualized by viewing the on/off status of light transmitting element 33 on the frontal visible side of the electrical connector 1.

Further more, the light emitting device 4 of the adaptor generates gathered light and projects to the light transmitting element 33 to make the light transmitting element 33 to glow clearly without light astigmatism or reflection by other objects thus the intensity of light is not relatively weakened providing a clear and obvious light indication on the front visible side of the electrical connector 1.

While the invention has been described in conjunction with a specific best mode, it is to be understood that many alternatives, modifications, and variations will be apparent to those skilled in the art in light of the a foregoing description. Accordingly, it is intended to embrace all such alternatives, modifications, and variations which fall within the spirit and scope of the included claims. All matters set forth herein or shown in the accompanying drawings are to be interpreted in an illustrative and non-limiting sense.

What the invention claimed is:

1. An electrical connector with a light emitting device, comprising:

a casing;

an insulative housing disposed inside the casing;

a pair of spaced apart slots disposed on top of the insulative housing, each of the slots comprising an opening on an end thereof;

a pair of light emitting devices, each of the light emitting devices disposed in a respective one of the slots, each of the light emitting devices comprising a plurality of conducting stands extending thereof;

a pair of light transmitting elements, each of the light transmitting elements disposed inside a respective one of the slots and configured for receiving light from a corresponding one of the light emitting devices;

the light transmitting elements are located at a distance apart from respective ones of the light emitting devices such that a length of each of the stands of the light emitting devices is configured to extend under the insulative housing; and the casing covers and surrounds the insulative housing, the light emitting devices and the light transmitting elements with a front side of the light transmitting elements and a front side of the insulative housing being exposed so that a signal transmission status of the electrical connector can be visualized by viewing an on/off status of the light emitting devices on a frontal visible side of the electrical connector.

2. The electrical connector according to claim 1, wherein each of the slots comprises at least one groove at a front end thereof for fixing said light transmitting elements on the insulation housing.

3. The electrical connector according to claim 1, wherein the light emitting devices comprise light gathering emitters configured to generate and project light onto the light transmitting elements.

4. The electrical connector according to claim 1, wherein each of the conducting stands has an L-shape.

* * * * *